US008622356B2

(12) United States Patent
Lerchner

(10) Patent No.: US 8,622,356 B2
(45) Date of Patent: Jan. 7, 2014

(54) SUPPORT FOR A MOTOR VEHICLE ATTACHMENT PART AND DEVICE FOR SUPPORTING A MOTOR VEHICLE ATTACHMENT PART

(75) Inventor: Henry Lerchner, Hannover (DE)

(73) Assignee: Blaupunkt Antenna Systems GmbH & Co. KG, Hildesheim (DE)

( * ) Notice: Subject to any disclaimer, the term of this patent is extended or adjusted under 35 U.S.C. 154(b) by 152 days.

(21) Appl. No.: 13/058,127

(22) PCT Filed: Aug. 7, 2009

(86) PCT No.: PCT/EP2009/060270
§ 371 (c)(1),
(2), (4) Date: Feb. 8, 2011

(87) PCT Pub. No.: WO2010/015700
PCT Pub. Date: Feb. 11, 2010

(65) Prior Publication Data

US 2011/0133047 A1 Jun. 9, 2011

(30) Foreign Application Priority Data

Aug. 8, 2008 (DE) ..... 10 2008 041 125

(51) Int. Cl.
*A47B 96/06* (2006.01)
*A47F 7/14* (2006.01)

(52) U.S. Cl.
USPC ..... 248/231.21; 248/226.21; 248/475.1

(58) Field of Classification Search
USPC ..... 248/154, 313, 346.06, 346.07, 346.5, 248/231.81, 231.9, 231.21, 67.7, 539, 248/226.11, 681, 475.1; 343/711, 713, 715, 343/878, 882, 888, 906; 403/197; 359/838, 359/841, 842, 871
See application file for complete search history.

(56) References Cited

U.S. PATENT DOCUMENTS

| | | | | |
|---|---|---|---|---|
| 5,865,638 | A * | 2/1999 | Trafton | 439/288 |
| 6,236,377 | B1 | 5/2001 | Hussaini et al. | |
| 6,419,198 | B1 * | 7/2002 | Einav | 248/346.07 |
| 6,860,454 | B1 * | 3/2005 | Gronowicz, Jr. | 248/71 |
| 7,492,319 | B2 * | 2/2009 | Lindackers et al. | 343/713 |
| 7,710,333 | B2 * | 5/2010 | Byrne et al. | 343/713 |
| 2001/0000617 | A1 * | 5/2001 | Tracy | 248/313 |
| 2011/0133047 | A1 * | 6/2011 | Lerchner | 248/231.21 |

FOREIGN PATENT DOCUMENTS

| | | |
|---|---|---|
| DE | 27 26 081 | 12/1978 |
| DE | 10 2006 009660 | 9/2007 |

OTHER PUBLICATIONS

International Search Report for PCT/EP2009/060270, mailed Dec. 17, 2009.

* cited by examiner

*Primary Examiner* — Tan Le
(74) *Attorney, Agent, or Firm* — Nixon & Vanderhye P.C.

(57) ABSTRACT

A support for a motor vehicle attachment part for installation at a chassis section of a motor vehicle provided with a receptacle opening. Two support elements that can be associated with opposite cables of the chassis section, are able to be tensioned toward one another by way of a clamping device. One of the support elements comprises a plurality of support arms. The support arms are mounted rotatably relative to one another in relation to an axis of rotation. A device for adhering a vehicle attachment part.

11 Claims, 4 Drawing Sheets

Figure 1:
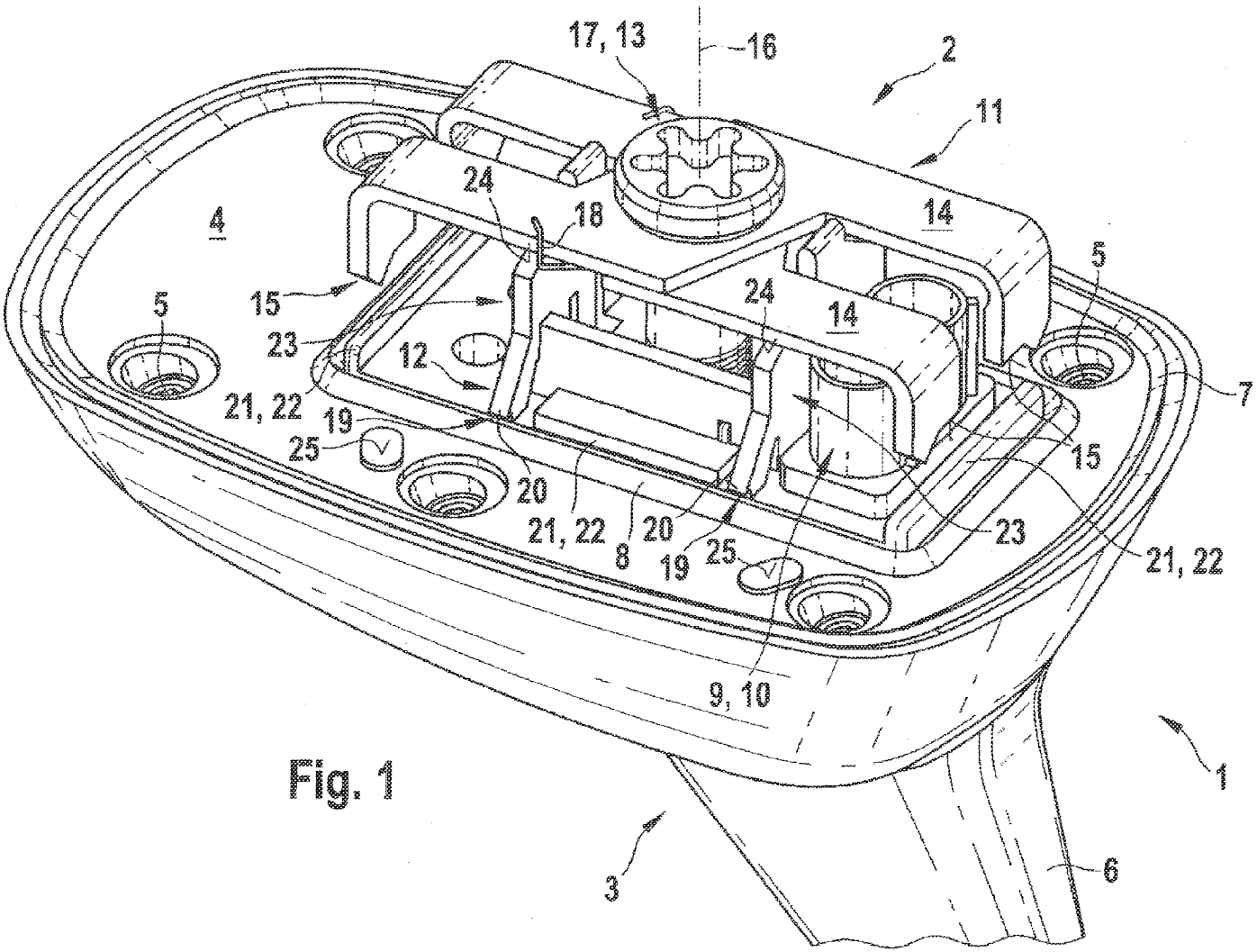

SUPPORT FOR A MOTOR VEHICLE ATTACHMENT PART AND DEVICE FOR SUPPORTING A MOTOR VEHICLE ATTACHMENT PART

This application is the U.S. national phase of International Application No. PCT/EP2009/060270, filed 7 Aug. 2009, which designated the U.S. and claims priority to German Application No. 10 2008 041 125.6, filed 8 Aug. 2008, the entire contents of each of which are hereby incorporated by reference.

The invention relates to a holder for a motor vehicle add-on part for assembly on a motor vehicle body part provided with a receiving opening, with two support elements which can be allocated to opposing sides of the body part and can be clamped toward one another by means of a clamping mechanism. Furthermore, the invention comprises a device for holding a motor vehicle add-on part.

PRIOR ART

Holders for a motor vehicle add-on part of the type mentioned at the outset are known. They are used to fasten a motor vehicle add-on part to a body part of the motor vehicle. Multi-part holder devices are frequently used in this case. These make it necessary for a first part of the holder device to be initially introduced into a receiving opening of the body part and secured there. In a further step, a second part used for the final fastening of the first part is then arranged on a second side of the body part and fastened to the first part of the holder device. This may be carried out by means of any fastening device, for example by means of a screw mechanism. Clipping mechanisms with elastic or resilient elements, which may lose their clamping force over time, or cause problems during disassembly, are frequently also used to hold the motor vehicle add-on part. Also, force introduction by the clipping mechanism frequently does not take place directly, but for example by spreading apart the resilient element. The two parts of the holder device in this variant embodiment cannot be moved toward one another by the fastening device to the extent desired and the body part cannot be clamped between them. Rather, fastening only takes place by widening the resilient elements in an opening of the body part, whereby only a small bearing face—namely the surface of the opening in the body part—is available for bracing the add-on part. This makes it necessary to adapt the holder to the respective body part, so it is not universally usable, for example amongst different motor vehicle series. A configuration with a clipping mechanism possibly also makes it necessary to select a multi-part configuration, in which the clamping mechanism, for example a screw, is not assembled until after the holder has been inserted into the receiving opening of the body part. If the clipping mechanism is to be made from plastics material, special plastics materials frequently have to be used. The clipping device is subjected to not inconsiderable forces, which conventional plastics materials might not withstand. When using a spreadable clipping mechanism, additional limitations with regard to the size and the shape of the holder are also placed on the design engineer. It is obvious that a clipping mechanism, for example spread apart by a screw, cannot be constructed to any desired size in terms of its diameter. The shape of the clipping device generally also has to be adapted to the shape of a fastening means, in other words generally a screw, and is therefore at least approximately circular.

DISCLOSURE OF THE INVENTION

In comparison, the holder for a motor vehicle add-on part with the features mentioned in claim 1 has the advantage that it can be easily and rapidly assembled or disassembled and ensures a lasting, secure fastening of the motor vehicle add-on part. This is achieved in that one of the support elements has a plurality of support arms, the support arms being rotatably mounted with respect to one another in relation to a rotational axis. The holder is introduced into the receiving opening of the body part and the two support elements are moved toward one another by means of the clamping mechanism. In this case, the support elements receive regions of the body part between them. In this case, they may be clamped toward one another until a sufficiently rigid seat of the body part is achieved, in particular by a press fit. One of the support elements has a plurality of support arms which can be rotated in relation to one another about the rotational axis. The support arms may thus be located in an angular position before assembly and be located in a further angular position after assembly. In this case, it is provided that the support arms can be brought through the receiving opening onto the side of the body part which can be allocated to them in one angular position. In the further angular position, the support arms are positioned in such a way that they cannot pass through the receiving opening again. If the support elements are clamped toward one another while the support arms are in the further angular position, the support arms of one support element come into contact with the side of the body part which can be allocated to the one support element. The other support element in this case rests on the opposing side of the body part. If the clamping mechanism is now used to further clamp the support elements toward one another, a secure seat of the holder for a motor vehicle add-on part is achieved. The two support elements are preferably rigid in configuration, in other words only have a small resilience.

A development of the invention provides that the support arms each have two, in particular opposing support faces. The support arms come into contact with the body part via the support faces. At least two of these support faces are provided on each support arm. They may, for example, be formed by end faces of the support arms, which have a bend in the direction of the body part. However, the support elements having the support faces may also be provided on the support arms. The support faces are advantageously arranged opposing one another, in particular in relation to the rotational axis. It is not necessary for the support face to extend parallel to the corresponding side of the body part. Rather, it may be provided that the support face has at least one bevel, and thereabove for example forms an edge which is used to secure against slipping of the support face relative to the body part.

A development of the invention provides that the support faces, viewed in a longitudinal direction of the support arms, are arranged laterally offset with respect to one another, in particular point-symmetrically with respect to an intersection point of the rotational axis with the support arms. This allows a space-saving arrangement of the support arms before assembly and makes stable fastening possible by means of a uniform distribution of the forces acting during the clamping of the clamping mechanism on the support elements.

A development of the invention provides that one support element forms a first support element and the other support element forms a second support element, which has at least one bearing face. The first support element can thus be allocated to one side of the body and the second support element can be allocated to the opposing side. The second support element has a bearing face, by means of which it comes into contact with the side of the body which can be allocated to it. Advantageously, a surface contact is present here to achieve an advantageous distribution of the forces produced by the clamping of the clamping mechanism and to simultaneously prevent twisting of the support element or the holder. A plurality of bearing faces may also be provided on the support element. These are advantageously arranged in such a way that the advantages already mentioned are present. Owing to the bearing face, a certain spacing of the support element from the body part may also be present. It is particularly advantageous if the bearing faces of the second support element oppose the support faces of the first support element or are arranged on the opposing side of the body part. This can prevent the body part being deformed by an action of force of the clamping mechanism when a spacing is provided between the second support element and the body part. Thus just as many bearing faces are preferably present as support faces.

A development of the invention provides that a preliminary latching mechanism for holding on the receiving opening is allocated to the second support element. Securing of the holder in the receiving opening is ensured by means of the preliminary latching mechanism during the assembly process, in other words after the introduction of the second support element into the receiving opening, but before the clamping process of the clamping mechanism. Consequently, the holder is initially introduced into the receiving opening until the preliminary latching mechanism produces a latching connection between the second support element and the receiving opening or the body part surrounding the receiving opening. The support arms of one support element can then be rotated with respect to one another and the support elements can be clamped toward one another by means of the clamping mechanism.

A development of the invention provides that the preliminary latching mechanism has at least one latching spring nose. The latching spring nose preferably has a projection which engages behind the body part and thus produces a latching connection or a preliminary latching mechanism between the body part and the second support element. The latching spring nose preferably has an oblique face and/or a spring action. During the introduction of the holder into the receiving opening, the oblique face comes into contact with an edging of the receiving opening so the latching spring nose is resiliently deflected. As a result, a simple introduction is ensured. If the second support element is introduced further into the receiving opening, in such a way that the edging of the receiving opening comes to rest behind the projection, the latching spring nose is again pressed in the direction of the edging by its spring action, whereby the latching spring nose or the projection of the latching spring nose engages behind the edging of the receiving opening and thus secures the holder in the receiving opening.

A development of the invention provides that the second support element has a centring device for centring the holder in the receiving opening. The centring device is provided to ensure a reproducible position of the holder or the motor vehicle add-on part in relation to the body part. This centring device centres the second support element or the holder in the receiving opening, in other words in relation to the body part. A simple introduction of the holder into the receiving opening is preferably also ensured by means of the centring device. This may be achieved, for example, in that the centring device has oblique faces or rounded areas, which bring the holder into a correct position during assembly.

A development of the invention provides that the clamping mechanism is a screw mechanism. For example, the two support elements may be screwed directly to one another. A direct introduction of force into the holder is thus ensured and therefore a rigid and lasting connection. The screw mechanism may already be present in a delivery state of the holder, so no additional step is necessary before assembly.

A development of the invention provides that the support arms adopt a first angular position before an assembly process and adopt a second angular position, which is different from the first angular position, after the assembly process. In the first angular position, the support arms are arranged in such a way that one support element can pass through the receiving opening of the body part and can therefore arrive at the side of the body part which can be allocated to it. Once the holder has moved into the assembly position, the support arms are rotated from the first angular position into the second angular position. The rotation takes place about the rotational axis. In this angular position, the support arms engage over side edges of the receiving opening, and thus rest over an edge region of the receiving opening and can no longer be displaced back through the receiving opening to the other side of the body part. It may also be provided that the support arms can be brought from the second into the first angular position during a disassembly process. In this case, the connection between the holder and the body part can be released again in that the clamping mechanism is released and the support elements are spaced apart. Thereafter, the support arms can be brought into the first angular position and one support element can therefore be guided through the receiving opening again.

A development of the invention provides that in the second angular position the first support element forms a support claw with a plurality of claw arms formed by the support arms. For example, the support claw can be formed in such a way that the claw arms initially extend horizontally outwards in the radial direction in order to then be bent vertically in the direction of the second support element. The angle of the bend can be selected as desired, but depends on a desired flexibility of the support element. While there is only a small flexibility with a bend of 90°, the flexibility or spring action at an angle of less than 90° is greater. The claw arms of the support claw may, for example, be arranged uniformly about the rotational axis. This produces a uniform distribution of the force exerted by the clamping mechanism.

A development of the invention provides that the support arms can be rotated by the clamping mechanism into the second angular position. The clamping mechanism is therefore also used to clamp the support elements toward one another and to rotate the support arms of one support element into the second angular position. For example, it may be provided that the rotation of the support arms into the second angular position occurs because of the clamping of the support elements toward one another. However, a rotation of the clamping mechanism, for example when this is designed as a screw mechanism, can also bring about the rotation of the support arms.

A development of the invention provides a spring element exerting a force in the direction of the first angular position on the support arms. Thus, unless there is a counter-force which rotates the support arms in the direction of the second angular position and which is greater than the force exerted by the spring element in the direction of the first angular position, the support arms are moved into the first angular position or held there. An unintentional rotation of the support arms in the direction of the second angular position is thus prevented, for example during transportation or assembly. It is thus ensured that the support arms only adopt the second angular position during or after assembly. If the support arms can be rotated by the clamping mechanism into the second angular position, the clamping mechanism has to apply a greater force than the spring element to move the support arms from the first into the second angular position.

A development of the invention provides attachment elements, in particular for plug connections, which are covered by the support arms in the first angular position and can be connected to connecting elements in the second angular position. The attachment elements can be used to produce an, in particular electrical, connection between the motor vehicle add-on part and further components of the motor vehicle. In order to avoid damage to the attachment elements, it is advantageous if these are only released after assembly. This means that they are to be substantially protected from mechanical influences and/or the penetration of dirt. This is achieved in that the attachment elements are covered by the support arms in the first angular position. During assembly, the support arms move into the second angular position and in the process release the attachment elements. These can now be connected to connecting elements. The attachment elements are particularly advantageously designed for plug connections. In this manner, both a rapid assembly of the motor vehicle add-on part on the body part by means of the holder and a production of a connection between attachment elements and connecting elements are possible.

The invention also relates to a device for holding a motor vehicle add-on part, with a holder, in particular according to the above configurations, and with a body part of the motor vehicle, the body part having a substantially rectangular receiving opening and the holder having support arms which are rotatably mounted with respect to one another and can pass through the receiving opening in a first angular position and are supported on an edge region of the receiving opening in a second angular position. In this case, the receiving opening has a cross-section such that in a first angular position, the support arms can arrive through the receiving opening from a first to a second side of the body part, whilst in a second angular position this is not possible. This means that the support arms are initially located in the first angular position, are moved through the receiving opening and are then brought into the second angular position so it is no longer possible for the support arms to move back through the receiving opening. In this second angular position, the support arms are supported on the edge region of the receiving opening. After, for example, support elements, at least one having the support arms, have been clamped toward one another by means of the clamping mechanism, the device for holding is rigidly connected to the body part of the motor vehicle. In the process, on one side of the body part the support arms come into contact as described and on the opposing side one of the support elements comes into contact, preferably a press contact, with the edge region of the receiving opening.

SHORT DESCRIPTION OF THE DRAWINGS

Figure 2:
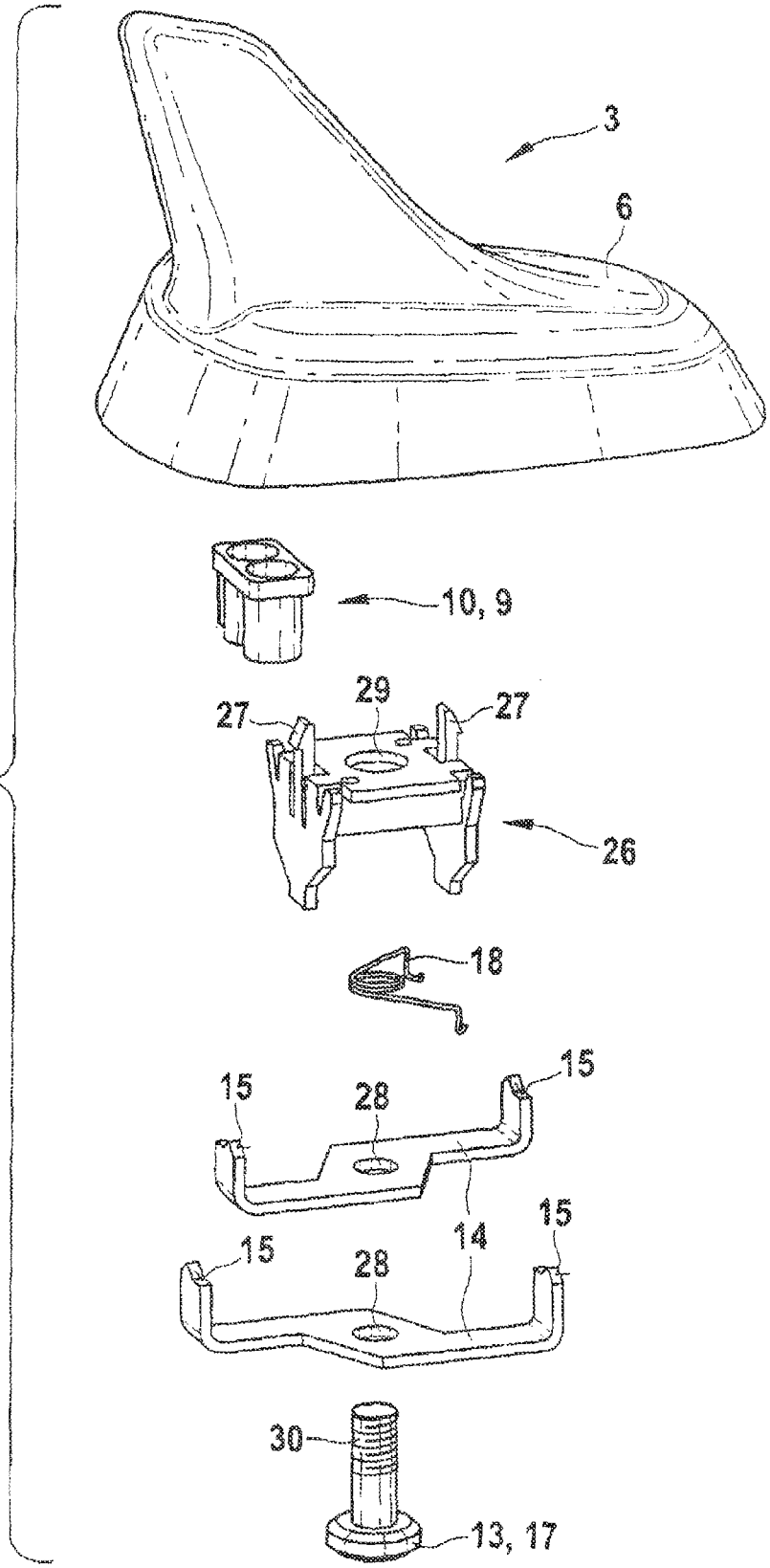
Figure 3:
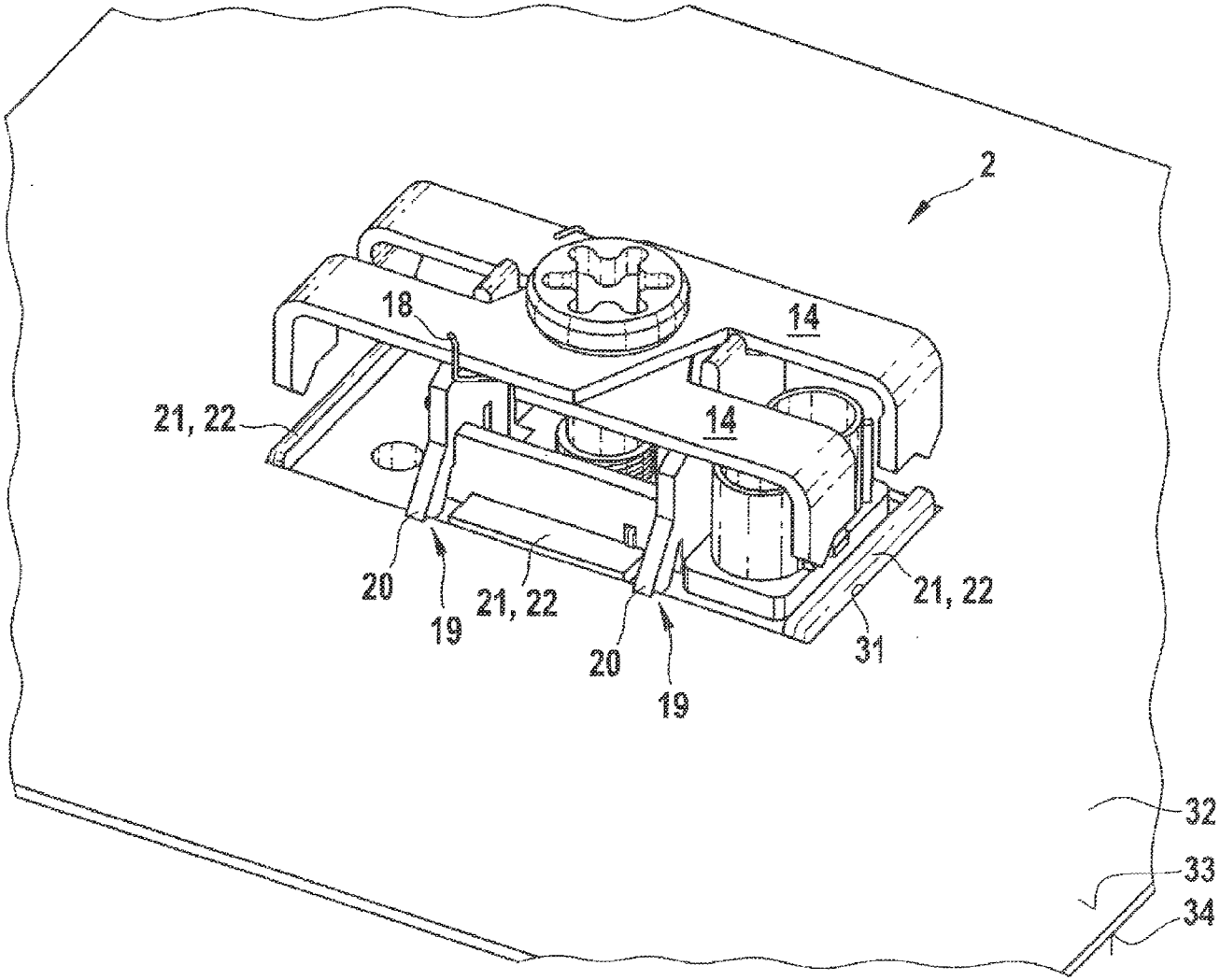
Figure 4:
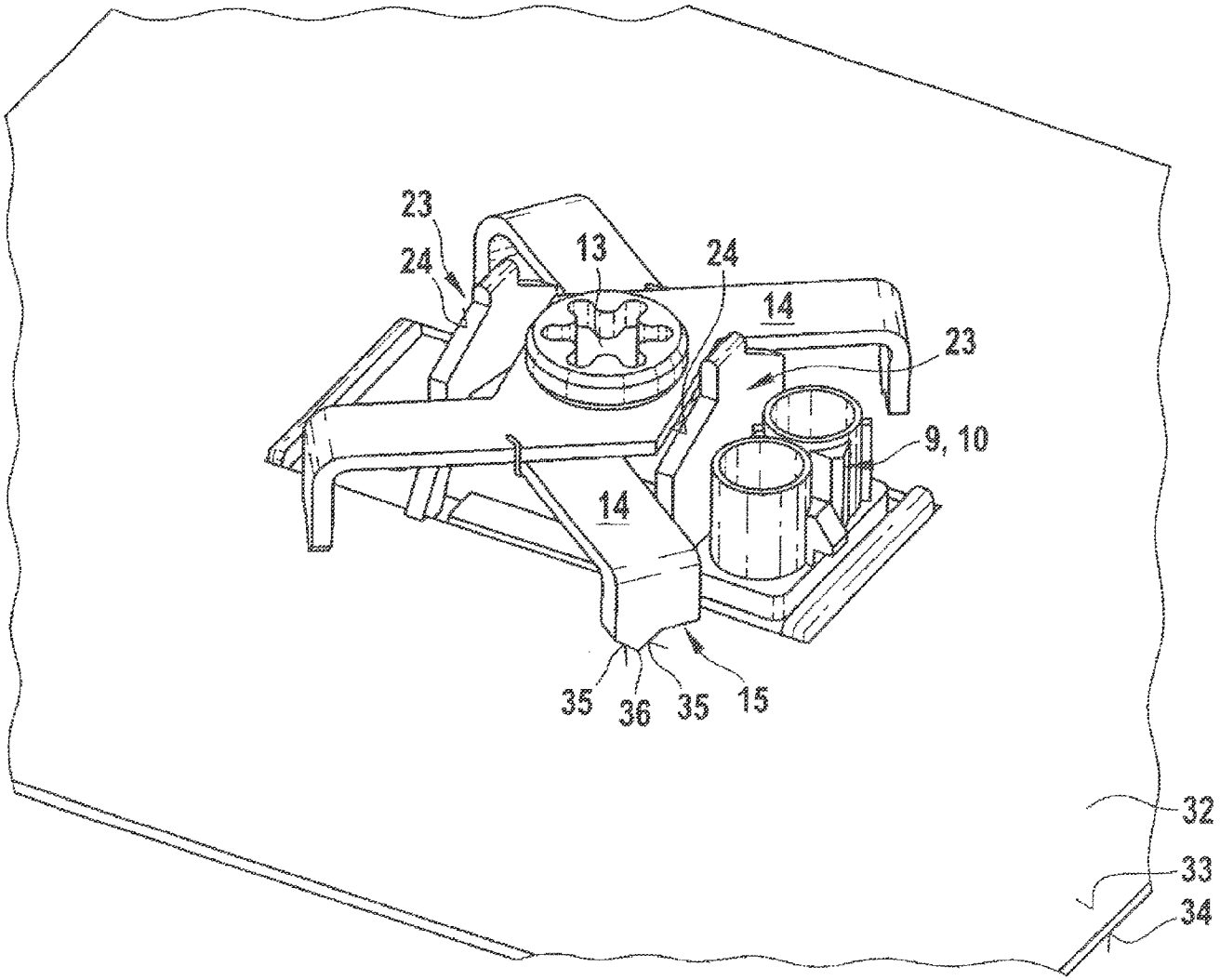

The invention will be described in more detail below with the aid of embodiments shown in the drawings, without in any way limiting the invention. In the drawings:

FIG. 1 shows a motor vehicle add-on part with a holder for assembly on a motor vehicle body part provided with a receiving opening, FIG. 2 shows an exploded view of the motor vehicle add-on part and the holder, FIG. 3 shows the holder inserted into the receiving opening, the support arms of the holder being in a first angular position, and FIG. 4 shows the holder from FIG. 3, the support arms being arranged in a second angular position.

EMBODIMENT(S) OF THE INVENTION

FIG. 1 shows a motor vehicle add-on part 1 with a holder 2 arranged thereon. The motor vehicle add-on part 1 is, in the example shown, an antenna 3 with a base plate 4, on which, for example, is arranged a printed circuit board, not shown, with the receiving lines and receiving systems. The base plate 4 is, for example, fastened by means of screw mechanisms 5 to a housing 6, in which the actual antenna 3 is arranged. Arranged between the base plate 4 and the housing 6 is a seal, not shown, which prevents the penetration of moisture and dirt. Provided on the outer periphery of the base plate 4 is a further seal 7, which during a placement of the motor vehicle add-on part 1 on a motor vehicle body part prevents the penetration of moisture and dirt between the motor vehicle add-on part 1 and the body part. A further seal 8 is also provided on the base plate 4, but directly surrounding the holder 2. An electric connection to the antenna 3 can be produced via attachment elements 9, which in this case are configured as plug connections 10. An electric connection can be produced to these attachment elements, for example by means of a connecting element, not shown. The holder 2 has a first support element 11, a second support element 12 and a screw mechanism 13. The first support element 11 and the second support element 12 can be displaced toward one another or be clamped toward one another by means of the screw mechanism 13. In the process, the support arms 14 allocated to the first support element 11 are displaced toward the second support element 12. Two support arms 14 are provided in the example shown in FIG. 1. These each have two support faces 15, which are formed by end sides of the support arms 14. The support faces 15, viewed in a longitudinal direction of the support arms 14, are arranged laterally offset with respect to one another and in each case point-symmetrically with respect to an intersection point of a rotational axis 16 with the support arms 14. The support arms 14 are rotatably mounted with respect to one another (in relation to the rotational axis 16) and are located in a first angular position in the example shown in FIG. 1. The first support element 11 and the second support element 12 can be displaced toward one another by means of the screw mechanism 13, in other words can be clamped toward one another, and thus the screw mechanism 13 is a clamping mechanism 17. Arranged on the support arms 14 of the first portion element 11 is a spring element 18, which exerts a force on the support arms 14 in the direction of the first angular position. This means that the support arms can only be moved, from the first angular position, in particular into the second angular position under the influence of a force which is greater than the force exerted by the spring element 18. The second support element 12 has a preliminary latching mechanism 19, with which the motor vehicle add-on part 1 can be held in a receiving opening until a secure connection between the motor vehicle add-on part and the body part of the motor vehicle is produced by means of the first portion element 11 and the second portion element 12. The preliminary latching mechanism 19 has at least one latching spring nose 20. This is resiliently configured, so that when the motor vehicle add-on part is pressed into the receiving opening of the body part, it can resiliently yield, and, once the latching spring nose 20 has passed through the receiving opening, can again adopt a starting position. In this manner, a latching connection can be produced between the holder 2 or the motor vehicle add-on part 1 and the body part of the motor vehicle. The second support element 12 also has a centring device 21 with at least one centring element 22. The centring elements 22 in this case preferably have oblique faces and/or rounded areas. The introduction of the holder 2 into the receiving opening of the body part is to be facilitated by means of the centring device 21. In particular, a precise and reproducible position of the motor vehicle add-on part 1 is to be achieved. The holder 2 also has guide elements 23 with guide faces 24 arranged thereon. If the first support element 11 is displaced by means of the screw mechanism 13 toward the second support element, the support arms 14 of the first support element 11 come into contact with the guide faces 24. As these are arranged obliquely, as soon as the screw mechanism 13 exerts a force on the first support element 11, the support arms 14 can run along the guide face 24 and therefore arrive in a second angular position. Provided on the base plate 4 are landing faces 25, by means of which the support faces 15 are positioned in the second angular position of the support arms 14. The holder 2 or the motor vehicle add-on part 1 is thus fixed in the receiving opening of the body part, in which the body part comes into contact, on one side, at least with the landing faces 25 and, on the opposing side, at least with the support faces 15 of the first support element 11. On tightening the screw mechanism 13, the holding force can thus be adjusted as desired within wide limits. Thus, a secure fastening of the motor vehicle add-on part 1 on the body part of the motor vehicle is ensured with a direct introduction of force.

FIG. 2 shows an exploded view of the motor vehicle add-on part 1. The housing 6 with the antenna 3, the plug connections 10, a base element 26 of the holder 2, the spring element 18, two support arms 14 allocated to the first portion element each with two support faces 15, and the clamping mechanism 17 configured as a screw mechanism 13 are shown. It is clear that the base element 26 can be latched into the housing 6 by means of latching elements 27. A final fastening takes place by means of the screw mechanism 13, for which a counter-thread, not shown, is provided in the housing 6. The counter-thread in the housing 6 may, for example, be cast in the material of the housing 6. The plug connections 10 are configured in the example shown in FIG. 2 as an independent component. They are arranged, as can be seen from FIG. 1, next to the base element 26 of the holder 2 on the housing 6. It can be seen that the screw mechanism 13 initially engages through holes 28 of the support arms 14, the spring element 18 and a hole 29 of the base element 26. Finally, a thread 30 of the screw mechanism 13 engages in the counter-thread of the housing 6.

FIG. 3 shows the holder 2 of the motor vehicle add-on part 1 in a receiving opening 31 of a body part 32 of a motor vehicle, not shown. The body part 32 has a first side 33 and a second side 34 opposing this. FIG. 3 shows the holder 2 during assembly, the support arms 14 being in a first angular position. In this first angular position, the support arms 14 can be guided through the receiving opening 31. FIG. 3 shows a moment during assembly at which the holder 2 has already been introduced into the receiving opening 31, so the second support element 12 or the landing faces 25 are in contact with the second side 34 of the body part 32 (not visible). Because of the centring elements 22 of the centring device 21, the holder 2 is arranged in the receiving opening 31 in a reproducible position and secured in the lateral direction against slipping. It can be seen that the latching spring noses 20 of the preliminary latching mechanism 19 have a latching connection with the first side 33 of the body part 32 and therefore secure the holder 2 against an unintentional movement out of the receiving opening 31. The spring element 18 holds the support arms 14 in the first angular position. The screw mechanism 13 is not yet tightened.

FIG. 4 shows the holder 2 known from FIG. 3, the support arms 14 now being located in a second angular position, which is different from the first angular position. The screw mechanism 13 is tightened, whereupon the first support element 11 is clamped toward the second support element 12. The support arms 14 are positioned in such a way that the support faces 15 are connected to the first side 33 of the body part 32. It can also clearly be seen in this view that the support face 15 has two oblique faces 35, which surround a support edge 36. If the screw mechanism 13 is sufficiently firmly tightened, the support edge 36 may cause a slight plastic deformation of the body part 32 and thus secure the support arms 14 against slipping and/or rotating. An extremely stable connection can thus be produced between the holder 2 and body part 32. It can also be seen that in the second angular position the support arms 14 release the plug connections 10, so an electric connection can be produced between this and connecting elements.

The following operation of the holder 2 is produced: in a delivery state, the support arms 14 are in the first angular position, as shown in FIG. 1. During assembly, the holder 2 or the first support element 11 is guided through the receiving opening 31 of the body part 32, the centring device 21 with the centring elements 22 allocated to it ensuring an exact and reproducible positioning of the holder 2 in the receiving opening 31. During the introduction of the holder 2 into the receiving opening 31, the latching spring noses of the preliminary latching mechanisms 13 come into contact with the body part 32 and are resiliently deflected. As soon as the holder 2 has been introduced to a sufficient extent into the receiving opening 31, so the latching spring nose 20 is no longer in contact with the body part 32, the latching spring nose 20 moves back again into its starting position. Thus, a return movement or an unintentional movement of the holder 2 out of the receiving opening 31 is ruled out. Furthermore, the landing faces 25 or, at least in regions, the support element 12 come into contact with the second side 34 of the body part 32. Thus, the holder 2 cannot be further introduced into the receiving opening 31. Thus, the state shown in FIG. 3 is reached. The screw mechanism 13 is then tightened. This brings about a clamping of the first support element 11 and the second support element 12 toward one another. The support arms 14 are pressed in the direction of the first side 33 of the body part 32 by means of this clamping toward one another or movement toward one another. In the process, they run over the guide faces 24 of the guide elements 23, while rotating with respect to one another. The guide faces 24 are designed in such a way that a rotation of the support arms 14 up to a second angular position takes place. A further tightening of the screw mechanism 13 merely brings about a further clamping toward one another of the support elements 11 and 12, in other words no further rotation of the support arms 14. Owing to the rotation of the support arms 14 into the second angular position, the plug connections 10 which were previously covered by the support arms 14 are released, so they can be connected to connecting elements (not shown). In the second angular position, the support arms 14 or the support faces 15 arranged thereon are positioned opposite the landing faces 25. This means that the body part 32 is clamped between the support faces 15 and the landing faces 25. A simple and rapid assembly, which ensures a secure and precisely positioned seat of the motor vehicle add-on part 1 on the body part 32, has thus taken place. FIG. 4 shows the assembled holder 2, the support arms 14 being in the second angular position and the screw mechanism 13 being tightened.

The invention claimed is:

1. Holder for a motor vehicle add-on part for assembly on a motor vehicle body part providing opposing sides including one side and an opposing side the motor vehicle body part defining a receiving opening therein, the holder comprising:

two support elements, which are allocated to the two opposing sides of the body part and are clampable toward one another by means of a clamping mechanism comprising a screw mechanism, the first support element being allocated to the one side of the vehicle body part and the second support element being allocated to the opposing side of the vehicle body part, wherein one of the support elements has a plurality of support arms, the support arms being rotatably mounted with respect to one another in relation to a rotational axis, the support arms having support faces which, viewed in a longitudinal direction of the support arms, are arranged laterally offset with respect to one another, point-symmetrically with respect to an intersection point of the rotational axis, which is orientated substantially vertically to the body part, with the support arms;

the second support element comprising two portion elements, the first portion element in contact with the support arms, the second portion element comprising a preliminary latching mechanism having at least one latching spring nose structured to secure the holder against unintentional movement out of the receiving opening.

2. Holder according to claim 1, wherein the support arms each have at least two opposing support faces.

3. Holder according to claim 1, wherein one support element forms a first support element and the other support element forms a second support element which has at least one bearing face.

4. Holder according to claim 3 wherein the preliminary latching mechanism is structured to hold on the receiving opening allocated to the second support element.

5. Holder according to claim 3, wherein the second support element has a centering device for centering the holder in the receiving opening.

6. Holder according to claim 1, wherein the support arms adopt a first angular position before an assembly process and adopt a second angular position, which is different from the first angular position, after the assembly process.

7. Holder according to claim 6, wherein in the second angular position, the first support element forms a support claw with a plurality of claw arms formed by the support arms.

8. Holder according to claim 1, wherein the support arms can be rotated by the clamping mechanism into the second angular position.

9. Holder for a motor vehicle add-on part for assembly on a motor vehicle body part providing opposing sides including one side and an opposing side, the motor vehicle body part defining a receiving opening, therein, the holder comprising:

two support elements, which are allocated to the two opposing sides of the body part and are clampable toward one another by means of a clamping mechanism comprising a screw mechanism, the first support element being allocated to the one side of the vehicle body part and the second support element being allocated to the opposing side of the vehicle body part, wherein one of the support elements has a plurality of support arms, the support arms being rotatably mounted with respect to one another in relation to a rotational axis, the support arms having support faces which, viewed in a longitudinal direction of the support arms, are arranged laterally offset with respect to one another, point-symmetrically with respect to an intersection point of the rotational axis, which is orientated substantially vertically to the body part, with the support arms;

the second support element comprising two portion elements, the first portion element in contact with the support arms, the second portion element comprising a preliminary latching mechanism having at least one latching spring nose structured to secure the holder against unintentional movement out of the receiving opening; and a spring element exerting a force in the direction of the first angular position on the support arms.

10. Holder according to claim 1, further comprising attachment elements, for plug connections, which are covered by the support arms in the first angular position and can be connected to connecting elements in the second angular position.

11. Device for holding a motor vehicle add-on part, with a holder for a motor vehicle add-on part for assembly on a motor vehicle body part providing opposing sides including one side and an opposing side, the holder comprising:

a receiving opening, having a first side and a side opposed thereto, with two support elements, which are allocated to the two opposing sides of the body part and are clampable toward one another by means of a clamping mechanism comprising a screw mechanism, the first support element being allocated to the one side of the vehicle body part and the second support element being allocated to the opposing side of the vehicle body part, wherein one of the support elements has a plurality of support arms, the support arms being rotatably mounted with respect to one another in relation to a rotational axis, the support arms having support faces which, viewed in a longitudinal direction of the support arms, are arranged laterally offset with respect to one another, point-symmetrically with respect to an intersection point of the rotational axis, which is orientated substantially vertically to the body part, with the support arms;

the second support element comprising two portion elements, the first portion element in contact with the support arms, the second portion element comprising a preliminary latching mechanism having at least one latching spring nose structured to secure the holder against unintentional movement out of the receiving opening; and a body part of the motor vehicle, wherein the body part has a substantially rectangular receiving opening and the holder has support arms which are rotatably mounted with respect to one another and, in a first angular position, can pass through the receiving opening and, in a second angular position, are supported on an edge region of the receiving opening.

* * * * *